US010135163B2

(12) United States Patent
Li et al.

(10) Patent No.: US 10,135,163 B2
(45) Date of Patent: Nov. 20, 2018

(54) ELECTRICAL CONNECTOR HAVING AN IMPROVED POWER TERMINAL

(71) Applicant: FOXCONN INTERCONNECT TECHNOLOGY LIMITED, Grand Cayman (KY)

(72) Inventors: Xin-Tian Li, Kunshan (CN); Bin Peng, Kunshan (CN); Zhi-Jian Chen, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/620,798

(22) Filed: Jun. 12, 2017

(65) Prior Publication Data

US 2017/0358879 A1 Dec. 14, 2017

(30) Foreign Application Priority Data

Jun. 12, 2016 (CN) ..... 2016 1 0406094

(51) Int. Cl.

| | |
|---|---|
| ***H01R 13/11*** | (2006.01) |
| ***H01R 13/04*** | (2006.01) |
| ***H01R 13/6587*** | (2011.01) |
| ***H01R 12/71*** | (2011.01) |
| ***H01R 13/514*** | (2006.01) |
| *H01R 12/73* | (2011.01) |

(52) U.S. Cl.

CPC ..... *H01R 12/716* (2013.01); *H01R 13/04* (2013.01); *H01R 13/514* (2013.01); *H01R 12/73* (2013.01); *H01R 13/113* (2013.01); *H01R 13/6587* (2013.01)

(58) Field of Classification Search

CPC ..... H01R 13/113; H01R 12/716; H01R 13/2492; H01R 13/2457; H01R 13/6587; H01R 13/6585

USPC ..... 439/856, 857, 862

See application file for complete search history.

(56) References Cited

U.S. PATENT DOCUMENTS 5,030,140 A * 7/1991 Sugiyama ..... H01R 13/6594 439/607.35

6,299,492 B1 * 10/2001 Pierini ..... H01R 13/26 439/884

6,394,818 B1 5/2002 Smalley, Jr.

(Continued)

FOREIGN PATENT DOCUMENTS

TW M434341 U1 7/2012

*Primary Examiner* — Renee S Luebke

*Assistant Examiner* — Paul Baillargeon

(74) *Attorney, Agent, or Firm* — Wei Te Chung; Ming Chieh Chang

(57) ABSTRACT

An electrical connector includes: an insulative housing defining a mating cavity upwardly communicating with an exterior through a top mating face thereof along an up-to-down direction, the mating cavity including a pair of side walls facing each other in a lengthwise direction perpendicular to the up-to-down direction; and a pair of flat power terminals retained in the two side walls of the mating cavity, respectively; wherein each flat power terminal includes a pair of elastic arms extending on two opposite sides thereof in the up-to-down direction, the pair of elastic arms of each flat power terminal are staggered in a transverse direction perpendicular to the up-to-down direction and the lengthwise direction.

9 Claims, 8 Drawing Sheets

(56) References Cited

U.S. PATENT DOCUMENTS

| | | | | |
|---|---|---|---|---|
| 6,685,512 | B2 | 2/2004 | Ooya | |
| 8,821,170 | B1 * | 9/2014 | Thein | H01R 4/4881<br>439/121 |

* cited by examiner

ELECTRICAL CONNECTOR HAVING AN IMPROVED POWER TERMINAL

BACKGROUND OF THE INVENTION

1. Field of the Invention

The present invention relates to an electrical connector having improved power terminals for providing reliable electrical performance between the electrical connector and anther butting connector.

2. Description of Related Arts

Taiwan Patent No. M434341, issued on Jul. 21, 2012, discloses an electrical connector including an insulative housing and a pair of flat power terminals retained in the housing. The housing includes a mating cavity and the pair of power terminals are set on opposite sides of the mating cavity. Each power terminal defines an elastic arm having a contacting portion protruding into the mating cavity.

SUMMARY OF THE INVENTION

An electrical connector comprises: an insulative housing defining a mating cavity upwardly communicating with an exterior through a top mating face thereof along an up-to-down direction, the mating cavity including a pair of side walls face each other in a lengthwise direction perpendicular to the up-to-down direction; and a pair of flat power terminals retained in the two side walls of the mating cavity, respectively; wherein each flat power terminal includes a pair of elastic arms extending on two opposite sides thereof in the up-to-down direction, the pair of elastic arms of each flat power terminal are staggered in a transverse direction perpendicular to the up-to-down direction and the lengthwise direction.

DETAILED DESCRIPTION OF THE PREFERRED EMBODIMENT

Figure 1:
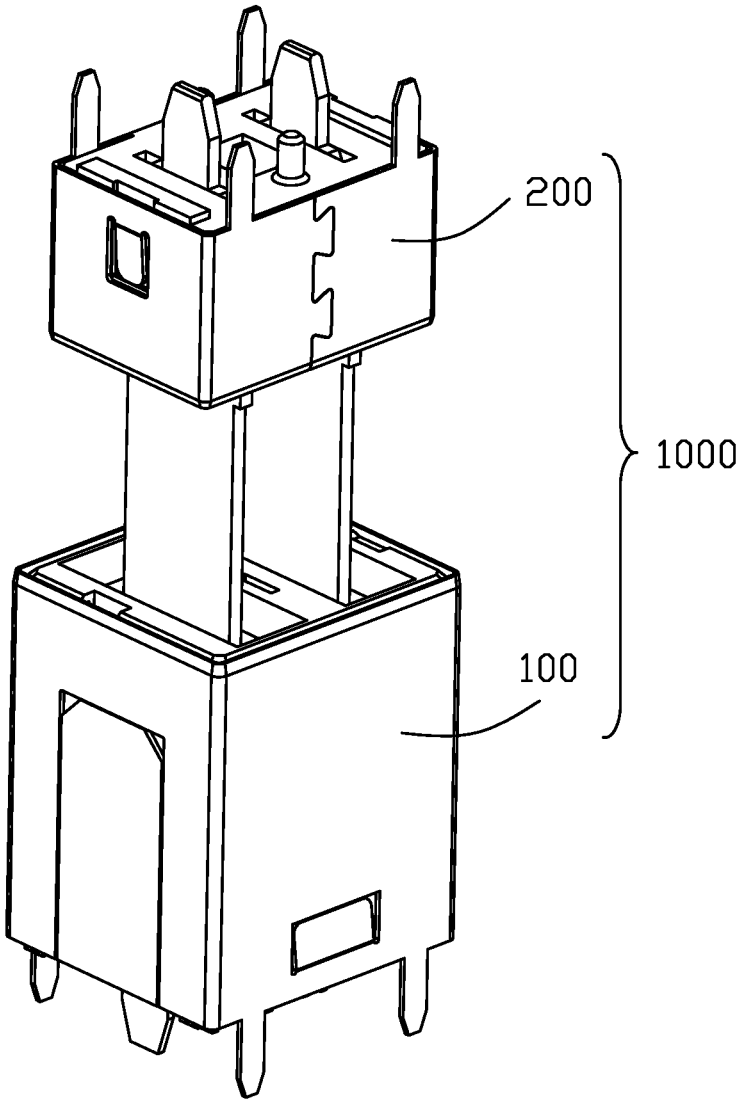
FIG. 1 is a perspective view of an electrical connector assembly in accordance with the present invention.
Figure 2:
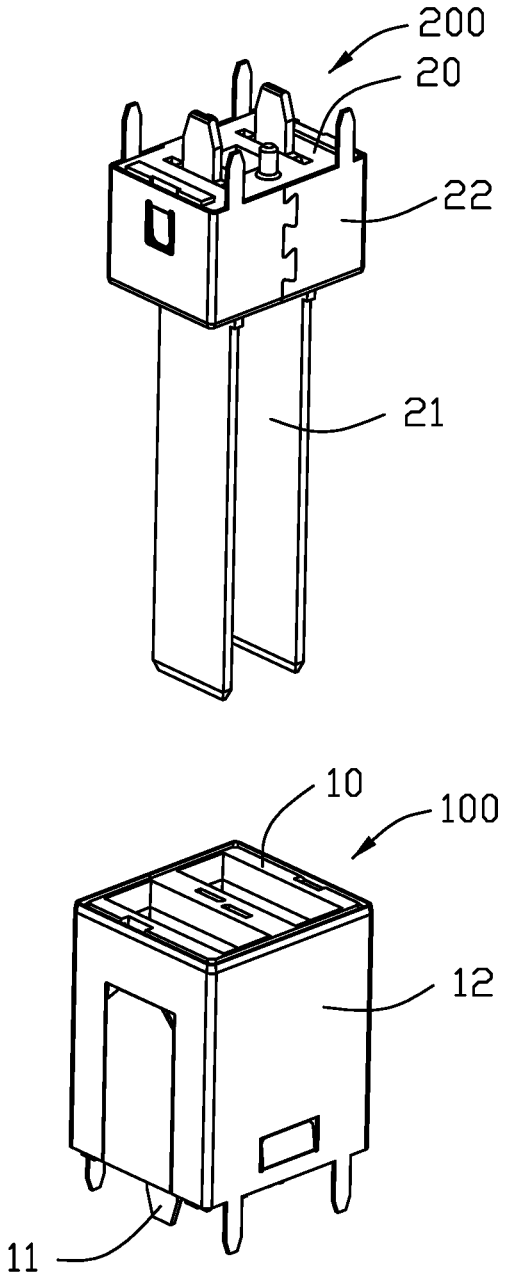
FIG. 2 is an assembled, perspective view of a electrical connector and a butting connector pulled out of the electrical connector.

Referring to FIGS. 1 and 2, an electrical connector assembly 1000 comprises an electrical connector 100 and a butting connector 200 matched with the electrical connector 100. The electrical connector 100 includes an insulative housing 10, at least one pair of flat power terminals 11 retained in the insulative housing 10 and a metal shell 12 covering the insulative housing 10. The butting connector 200 includes a butting housing 20, at least one flat butting terminal 21 retained in the butting housing 20, and a shielded shell 22 covering the butting housing 20.

Figure 3:
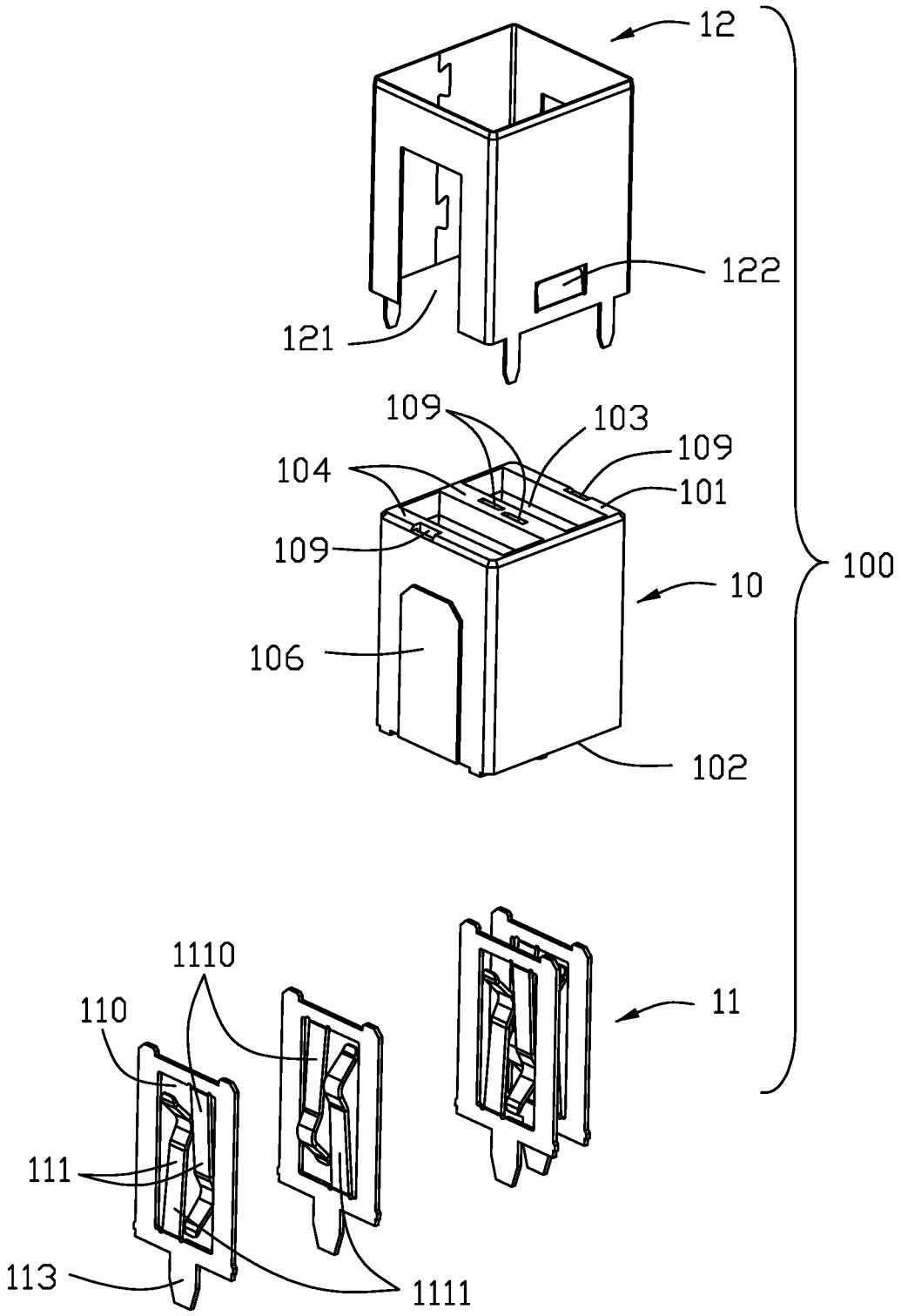
FIG. 3 is an exploded view of the electrical connector.
Figure 4:
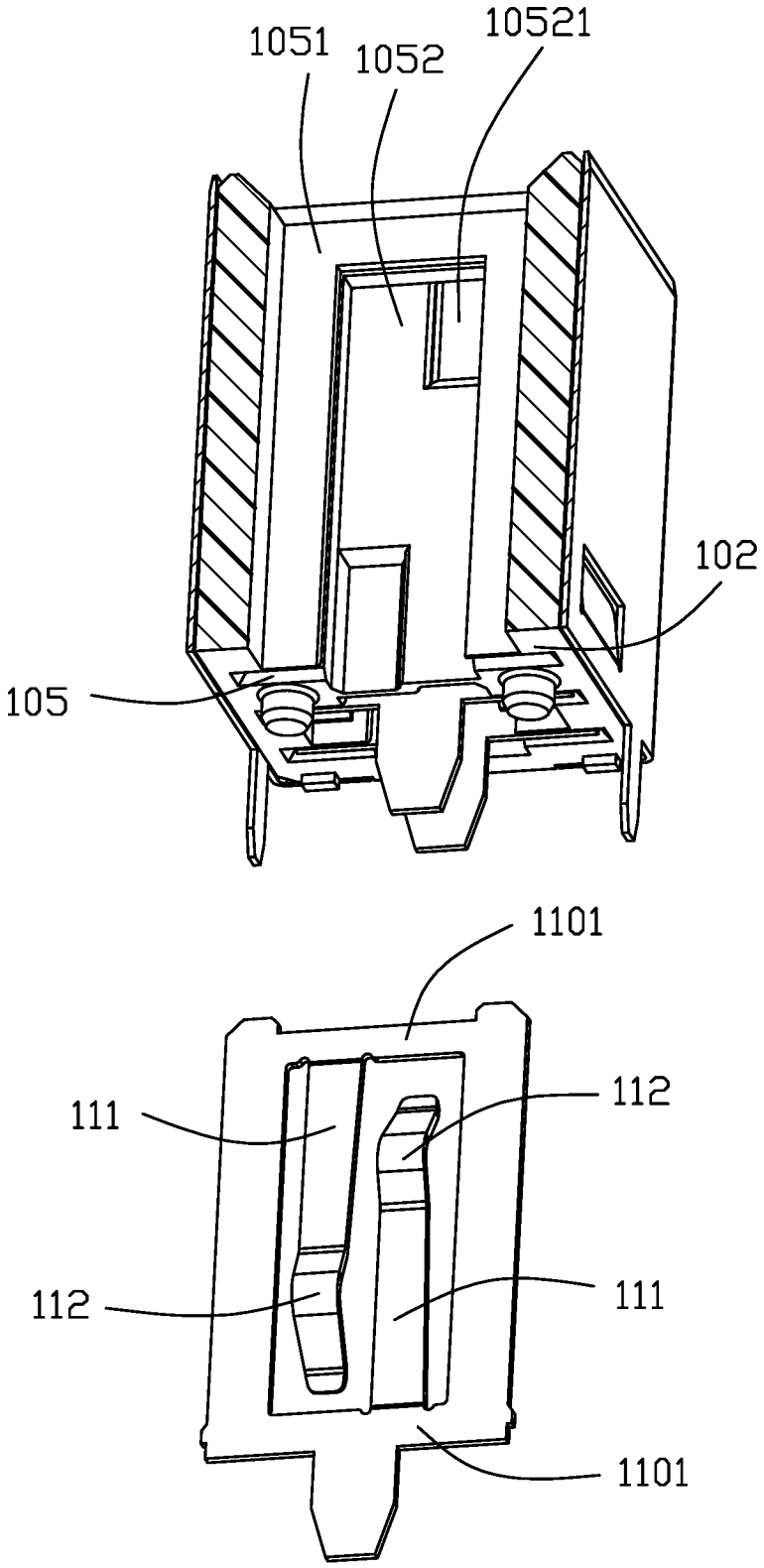
FIG. 4 is an enlarged view of the electrical connector with a terminal set out of the insulative housing.
Figure 5:
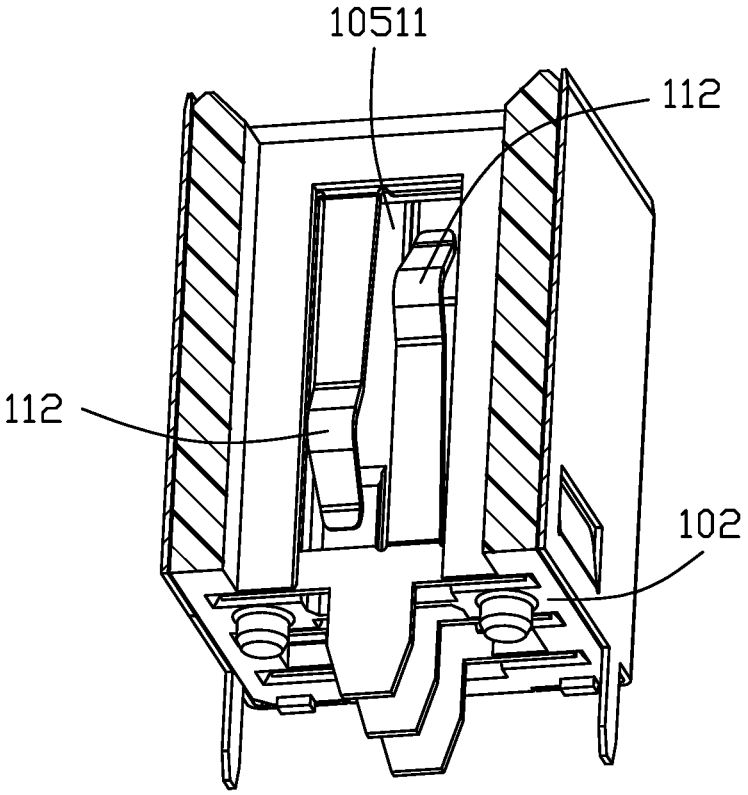
FIG. 5 is another enlarged view of the electrical connector with a terminal set in the insulative housing.

Referring to FIGS. 3 to 5, the insulative housing 10 defines a top mating face 101 and a bottom mounting face 102 opposite to the top mating face 101 in an up-to-down/vertical direction. The insulative housing 10 includes at least one mating cavity 103 runs through the top mating face 101 and the bottom mounting face 102, the mating cavity 103 includes a pair of side walls 104 facing each other in a lengthwise/front-to-back direction perpendicular to the up-to-down direction, each side wall 104 extends in a transverse plane and defines a retaining slot 105 is set on the bottom mounting face 102 for retaining the flat power terminals 11. The insulative housing defines a pair of lugs 106 located on two opposite outer sides and a pair of grooves (not shown) located on another opposite outer sides, the metal defines metal shell 12 includes a pair of notches 121 and clips 122 matching corresponding lugs 106 and grooves (not shown) respectively when the metal shell is installed on the outer side of the insulative housing from the up-to-down direction.

Referring to FIGS. 3 to 5, each flat power terminal 11 includes a pair of elastic arms 111 spaced from each other in the transverse direction perpendicular to both the up-to-down direction and the lengthwise direction, and extending on two opposite sides thereof in the up-to-down direction and a soldering portion 113 extending out of the bottom mounting face 102. The pair of elastic arms 111 of each flat power terminal 11 are staggered in a transverse direction perpendicular to the up-to-down direction, each elastic arm 111 includes a contacting portion/point 112 protruding into the mating cavity 103. Specifically, each flat power terminal 11 includes a hollow area 110 for setting the pair of elastic arms 111, the hollow defines two opposite side edges 1101 in the up-to-down direction and the pair of elastic arms 111 extending from the opposite side edges 1101 thereon respectively, the soldering portion 113 extends downwardly from a bottom side edge 1101. Each flat power terminal 11 receives in the retaining slot 105 from a bottom to top, the retaining slot 105 defines a first wall 1051 and a second wall 1052 opposite to the first wall 1051 in the lengthwise direction. The first wall 1051 defines an opening 10511 connecting to the mating cavity 103 for the contacting portion 112 to protrude into the mating cavity 103 and the second wall 1052 defines a recess 10521 for receiving the contacting portion 112 when the flat butting terminal insert into the mating cavity 103.

Figure 6:
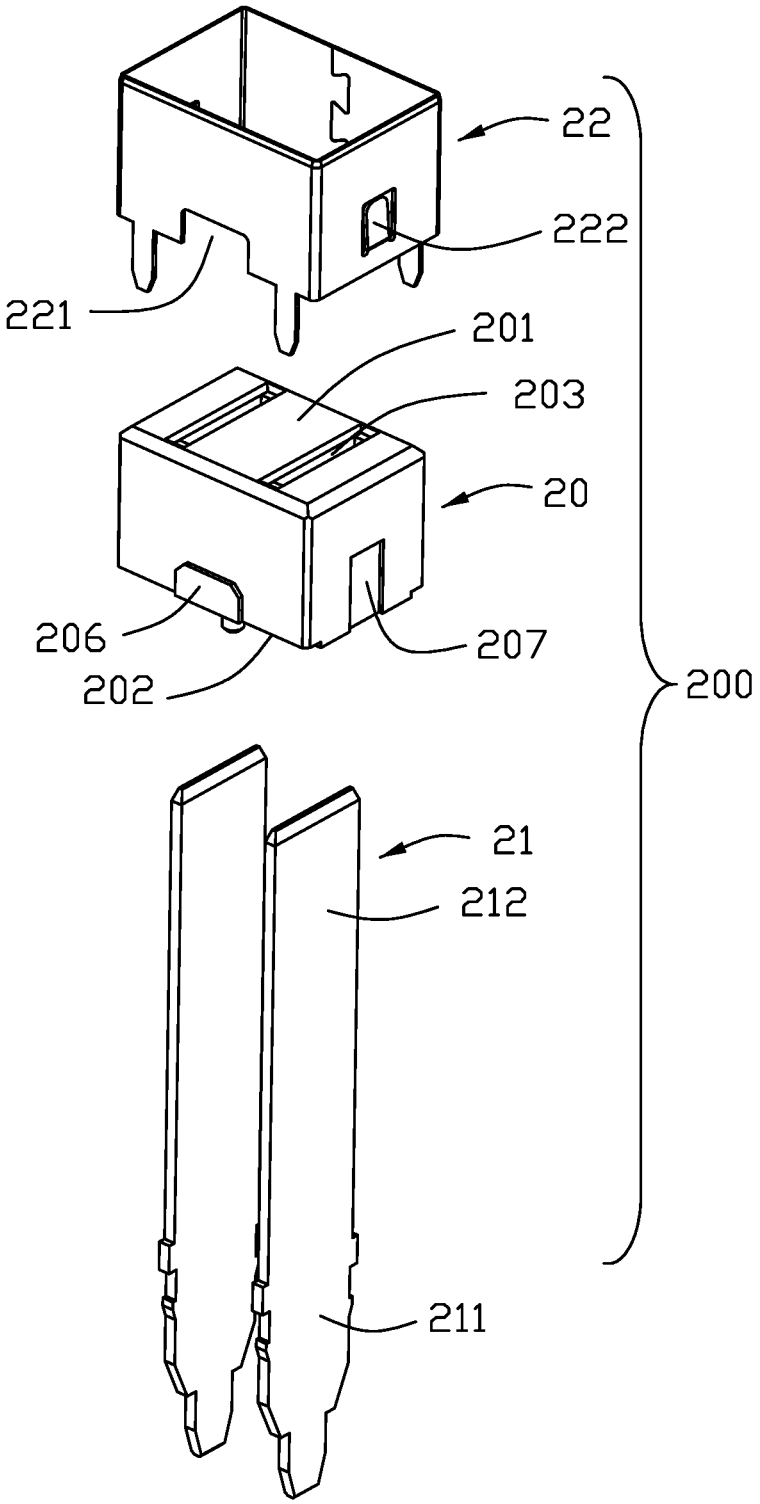
FIG. 6 is an exploded view of the electrical connector.
Figure 7:
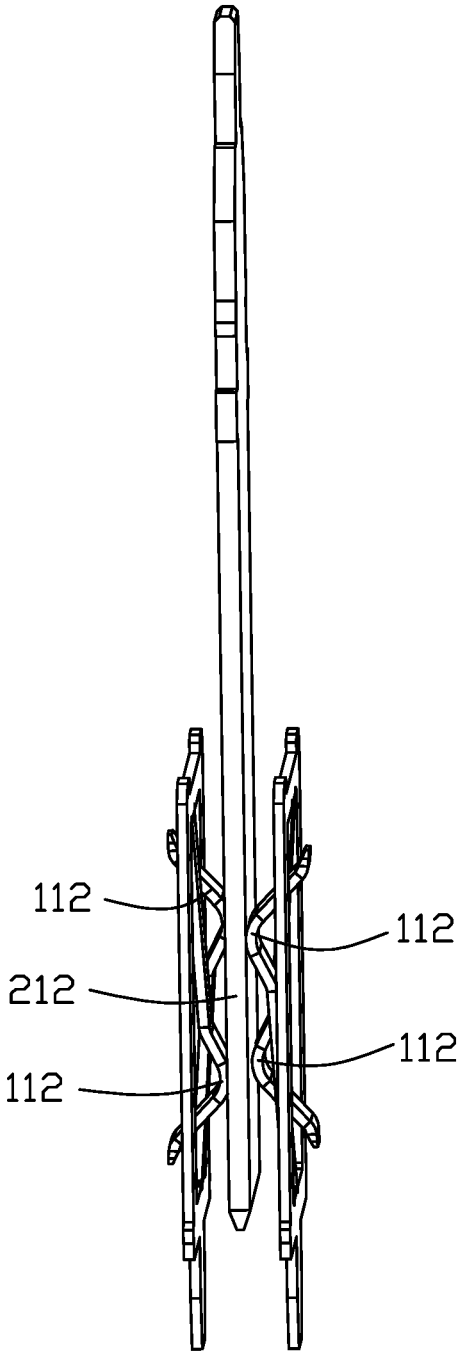
FIG. 7 is a view showing a pair of terminals of the electrical connector contact with a butting terminal of the butting connector.
Figure 8:
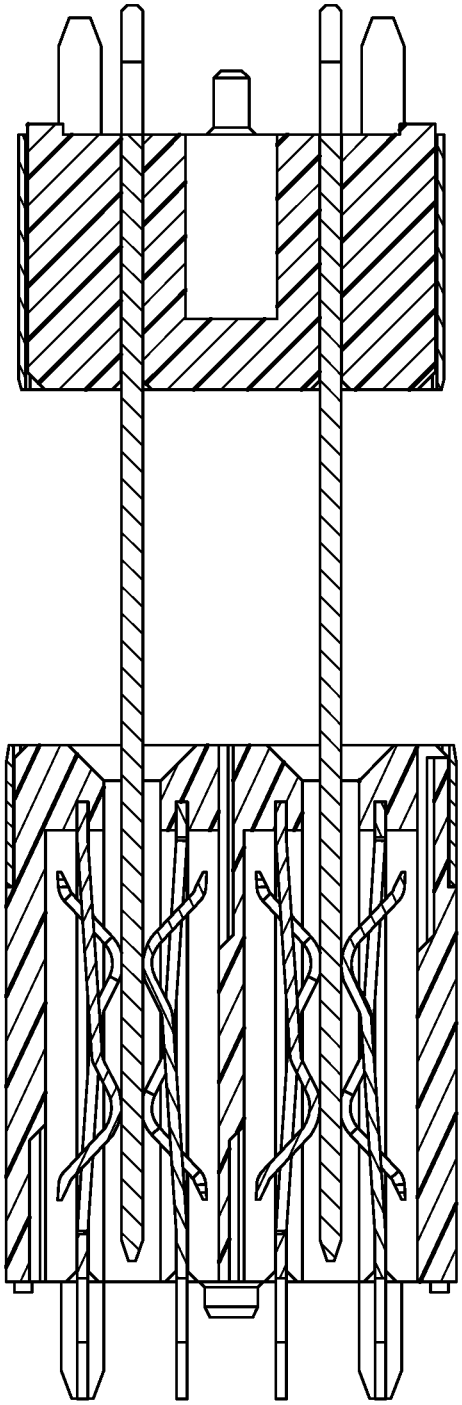
FIG. 8 is a cross-sectional view of the electrical connector assembly of FIG. 1.

Referring to FIGS. 6 and 7, the butting housing 20 defines an upper butting face 201 and a bottom installing face 202 opposite to the butting face 201, the butting housing 20 includes at least one fixing slot 203 runs through the butting face 201 and the installing face 202 for retaining the flat butting terminal 21. The flat butting terminal 21 includes a fixing portion 211 retained in the fixing slot 203 and a flat butting portion 212 protruding from the upper butting face 201 for inserting into the mating cavity 103. The flat butting portion 212 connects between two pairs of elastic arms 111 of pair of the flat power terminals 11 when the electrical connector 100 connects to the butting connector 200. The butting housing 20 defines a pair of s 206 located on two opposite sides and a pair of grooves 207 located on another opposite sides, the shielded shell 22 defines a pair of notches 221 and a pair of clips 22 matching corresponding lugs 206 and grooves 207.

More specifically, each pair of contacting portions 112 of each flat power terminal 11 do not overlap in the up-to-down direction. Preferably, each pair of contacting portions 112 of each flat power terminal 11 extend beyond each other in the up-to-down direction that each elastic arm 111 has a longer length and better elastic.

Besides that, the pair of flat power terminals 11 define a pair of first elastic arms 1110 having a same height extending in a first same direction and a pair of second elastic arms 1111 having a same height extending in a second same direction, the pair of first elastic arms 1110 and the pair of second elastic arms 1111 are staggered in the transverse direction respectively so as to make two connectors match reliable. From another viewpoint, on one hand for each flat power terminals 11 the elastic arm 1110 has the corresponding contacting portion 112 lower than the corresponding contacting portion 112 of the elastic arm 1111 so as to assure constant connection between the butting terminal 21 and each terminal 11 disregarding whether the connector 100 and the butting connector 200 are fully mated with each other in the vertical direction or not. On the other hand, one elastic arm 1111 and the other elastic arm 1111 are offset from each other in the transverse direction so as to assure connection between the butting terminal 21 and the elastic arm 1111 of at least one terminal 11 even if the butting terminal 21 is not correctly positioned at the predetermined center position with regard to each terminal 11 in the transverse direction but with an offset in the transverse direction. Similarly, the butting terminal 21 always has a connection with at least one of the elastic arm 1110 of the other terminal 11. In other words, in the instant invention the two offset contacting points on one side of the butting terminal 21 cooperate with anther two offset contact points on the other side of the butting terminal 121 for assuring reliable connection wherein the two offset contacting points on one side and the two contacting points on the other side are not symmetrical with each other in the lengthwise/front-to-back direction but reversely symmetrical with regard to the butting terminal 21 in the lengthwise/front-to-back direction. It is also noted that because there are a pair of terminals 11 at two sides of the corresponding butting terminal 21, any offset in the front-to-back direction between the terminals 11 and the butting terminal 21 will result in at least one terminal 11 efficiently contacting the butting terminal 21. Based upon this sandwiching and the dual elastic arms with offset contacting portions of the terminals 11, any misalignment between the terminals and the butting terminal 21 in any of the vertical direction, the transverse direction and the front-to-back direction will not result in disconnection therebetween. It is also noted that for the injection molding consideration of the housing 10, openings 109 are formed in the housing to vertically communicate with the recesses 10521. It is noted that because the recesses 10521 are offset from each other in the middle side wall 104, the openings 109 in the middle side wall 104 are also offset from each other in both lengthwise direction and the transverse direction.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector assembly comprising:

a first connector including:

an insulative housing defining at least one mating cavity communicating with an exterior along a vertical direction;

a pair of terminals retained by two sides of the mating cavity and spaced from each other in a front-to-back direction perpendicular to said vertical direction, each of said terminals having a flat portion extending along a transverse plane in said vertical direction with a pair of elastic arms which are spaced from each other in a transverse direction perpendicular to both said vertical direction and said front-to-back direction and respectively equipped with an upper contacting point and a lower contacting point spaced from each other in the vertical direction;

a second connector including:

an insulative butting housing;

a blade type butting terminal retained in the butting housing; wherein during mating, the blade type butting terminal is sandwiched between the pair of terminals in the front-to-back direction with four contacting points therebetween, the insulative housing forms recesses to receive free ends of corresponding elastic arms, respectively, and the recesses in a same side wall of the insulative housing and facing the at least one mating cavity are offset from each other.

2. The electrical connector assembly as claimed in claim 1, wherein the upper contacting point and the lower contacting point of one of said pair of terminals are reversely symmetrical with those of the other of said pair of terminals with regard to the butting terminal.

3. The electrical connector assembly as claimed in claim 1, wherein the elastic arm with the upper contacting point extends upwardly from a lower portion of the corresponding flat portion while the elastic arm with the lower contacting point extends downwardly from an upper portion of the corresponding flat portion.

4. The electrical connector assembly as claimed in claim 1, wherein the insulative housing further forms a plurality of openings communicating with corresponding recesses in the vertical direction, respectively.

5. The electrical connector assembly as claimed in claim 1, wherein the insulative housing has two mating cavities divided by a middle side wall thereof, and the recesses in the middle side wall of the insulative housing and facing different mating cavities are offset from each other.

6. An electrical connector assembly comprising:

a first connector including:

an insulative housing defining at least one mating cavity communicating with an exterior along a vertical direction; and a pair of terminals retained by two sides of the mating cavity and spaced from each other in a front-to-back direction perpendicular to said vertical direction, each of said terminals having a flat portion extending along a transverse plane in said vertical direction with a pair of elastic arms which are spaced from each other in a transverse direction perpendicular to both said vertical direction and said front-to-back direction and respectively equipped with an upper contacting point and a lower contacting point spaced from each other in the vertical direction; and a second connector including:

an insulative butting housing;

a blade type butting terminal retained in the butting housing, wherein during mating, the blade type butting terminal is sandwiched between the pair of terminals in the front-to-back direction with four contacting points therebetween, the insulative housing forms recesses to receive free ends of corresponding elastic arms, respectively, and the insulative housing has two mating cavities divided by a middle side wall thereof, and the recesses at two opposite sides of the middle side wall are offset from each other in both the front-to-back direction and the transverse direction.

7. The electrical connector assembly as claimed in claim 6, wherein the upper contacting point and the lower contacting point of one of said pair of terminals are reversely symmetrical with those of the other of said pair of terminals with regard to the butting terminal.

8. The electrical connector assembly as claimed in claim 6, wherein the elastic arm with the upper contacting point extends upwardly from a lower portion of a corresponding flat portion while the elastic arm with the lower contacting point extends downwardly from an upper portion of a corresponding flat portion.

9. The electrical connector assembly as claimed in claim 6, wherein the insulative housing further forms a plurality of openings communicating with corresponding recesses in the vertical direction, respectively.

* * * * *